United States Patent [19]

Teichert

[11] 4,412,196

[45] Oct. 25, 1983

[54] SOLENOID FOR DIRECTIONAL VALVES

[75] Inventor: Rainer Teichert, Plymouth, Mich.

[73] Assignee: Double A Products Company, Manchester, Mich.

[21] Appl. No.: 366,629

[22] Filed: Apr. 8, 1982

[51] Int. Cl.[3] ..... H01F 7/10

[52] U.S. Cl. ..... 335/250; 251/137; 335/246; 336/107

[58] Field of Search ..... 335/250, 246; 310/71; 307/151; 336/107, 150; 361/160; 363/142, 143; 251/137, 129, 140; 339/32, 33

[56] References Cited

U.S. PATENT DOCUMENTS

| | | | |
|---|---|---|---|
| 2,792,559 | 5/1957 | Maberry | 339/32 R |
| 3,034,000 | 5/1962 | Todd | 336/107 |
| 4,056,255 | 11/1977 | Lace | 251/137 |

*Primary Examiner*—Harold Broome

*Attorney, Agent, or Firm*—Stephenson & Boller

[57] ABSTRACT

A solenoid operated directional valve comprises a plug-in type solenoid which makes electrical connection with a terminal block on the valve body via plug-in type terminals. The plug-in type terminals are on a connector element which is selectively positionable on the solenoid to select either a portion of the solenoid winding which is for 60 hertz energizing current or a portion which is for 50 hertz current.

20 Claims, 16 Drawing Figures

SOLENOID FOR DIRECTIONAL VALVES

BACKGROUND AND SUMMARY OF THE INVENTION

The present invention relates to solenoid actuated directional valves and is particularly concerned with an improvement for readily converting valves for use with either 50 hertz or 60 hertz alternating current without the necessity of either re-wiring or replacing the solenoids.

Solenoid actuated valves, such as hydraulic directional valves, are used in fluid power systems to control the flow of pressure fluid to components of the fluid power system. The directional valve comprises a valve body having a central bore having axially spaced annuli and within which a landed valve spool is disposed. The spool is shifted axially of the bore to selectively connect selected ports of the valve so that flow in the fluid circuit containing the valve is thereby controlled. In a solenoid actuated valve the valve spool is shifted within the bore by operation of one or more solenoids.

In the United States where 115 volt, 60 hertz, AC power is generally available the valve solenoids are designed to operate with maximum efficiency at that electrical voltage and frequency. While a solenoid may be capable of operating at actual line voltages and frequencies which depart from the nominal design values, the operating characteristics increasingly depart from optimum as the electrical power characteristics increasingly depart from their nominal values. For example, if the power frequency decreases from the nominal 60 hertz value, the inductive reactance of the solenoid coil similarly decreases because the inductive reactance is directly proportional to the line frequency. Consequently the current draw by the solenoid coil increases which itself gives rise to increased power consumption appearing as increased heat in the solenoid winding. Apart from the inefficient use of the electrical power, heat can have a deteriorating effect on the solenoid if it becomes too severe. Correspondingly, where the frequency of the power supply increases, the solenoids do not operate as well at the higher frequency because of reduced current draw and a resultant reduction in effective operating force.

Not all sites where directional control valves are used have 60 hertz electrical power available. For example in many areas of the world other than 60 hertz power is the rule. A typical figure in certain countries is 50 hertz power. The application of 50 hertz power to a solenoid coil which is designed for 60 hertz power, and vice versa, can have undesiable consequences, chiefly for the reasons explained above. Where an existing machine or piece of equipment which includes solenoid operated valves is to be relocated from one installation site to another where the electrical power supplied at the respective locations are at different frequencies, it has heretofore often been necessary to replace the solenoids with the new solenoids which are compatible with the new electrical power supply characteristics. Needless to say, the task of replacing the solenoids is a significant inconvenience. It involves the use of electricians who remove the old solenoid coils by disconnecting electrical lead wires of the solenoids from terminal blocks on the valve bodies. The new solenoids are installed and their lead wires are connected to the terminal blocks. Thus the total cost involved includes both the cost of new replacement solenoids and the labor cost in replacing the solenoids as well.

Even if a solenoid is manufactured with a tap allowing use with either 50 hertz or 60 hertz power, it is still necessary to rewire the solenoid leads on the terminal block whenever the valve is converted for use at a new frequency. If a compromise design is used so that replacement and rewiring are not required (for example say a 55 hertz design), actual operation (i.e. at either 50 hertz or 60 hertz) is never optimum.

The present invention is directed to a improvement in a solenoid operated directional valve whereby it is unnecessary to replace the solenoid assembly when the frequency of the electrical power supply changes from one frequency to another. Furthermore, the procedure involved in converting the solenoid for its new use can be done without the need to rewire the lead wires of the solenoid on the terminal blocks, and this results in a savings in labor cost in the changeover of a solenoid. The invention also provides improvement in other respects.

Where a manufacturer manufactures a range of different sized valves there are often various valve models which can use the same solenoid insofar as the electrical characteristics of the solenoid are concerned. This is particularly the case for valves having plug-in type solenoids such as disclosed in the commonly assigned prior patent application Ser. No. 241,355 filed Mar. 6, 1981. The dimensions of the valve bodies of the respective models may however be slightly different so that when a given solenoid design is suitable for use with two different valve bodies there may be some type of an adapter between the solenoid and one or more of the valve bodies whereby the solenoid is rendered compatable with all valve bodies. The present invention allows a solenoid to be capatible with many different valve bodies thereby eliminating use separate adapter elements.

Briefly a valve of the present invention has a connector element for switching between 50 and 60 cycle operation, and it can be configured to inherently incorporate the adapter function where an adapter would otherwise be required. Hence the advantage of this aspect of the invention is that a greater commonality of component parts is possible thereby minimizing manufacturing considerations and inventory requirements. The invention, in its disclosed preferred embodiment, allows a solenoid to be changed from 50 hertz to 60 hertz operation simply by disassembling the solenoid assembly from the valve assembly, repositioning the connector element on the solenoid assembly, and then reassembling the solenoid assembly to the valve assembly. There is no need to unfasten or refasten lead wires from or to terminal blocks. Furthermore because there are no lead wires on the solenoid assembly it is less susceptible to damage than other types of solenoids having lead wires where the lead wires may be grabbed to carry the solenoid.

Further advantages, features and benefits of the invention, along with the above, will be seen in the ensuing description and claims which should be considered in conjunction with the accompanying drawings. The drawings disclose a preferred embodiment of the invention according to the best mode contemplated at the present time in carrying out the invention.

BRIEF DESCRIPTION OF THE DRAWINGS

FIG. 11 is a view of a further element shown by itself, with

FIG. 14 is a view similar to FIG. 6 illustrating a modified form, with

DESCRIPTION OF THE PREFERRED EMBODIMENT

Figure 1:
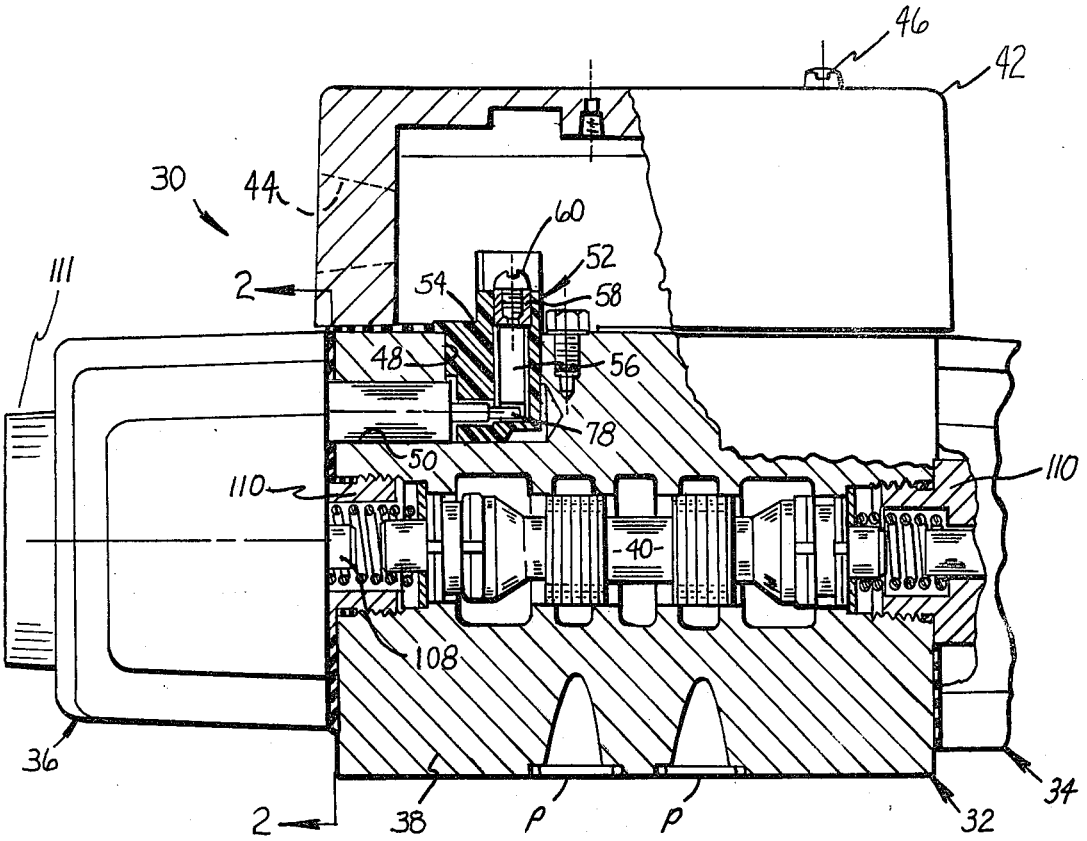
FIG. 1 is a front vertical sectional view having a portion broken away illustrating a solenoid operated directional valve embodying principles of the present invention.

FIG. 1 illustrates a valve 30 embodying principles of the present invention. The disclosed valve is a double solenoid, directional valve type comprising a valve assembly 32 with a solenoid assembly 34 on the right-hand end and a solenoid assembly 36 on the left-hand end. The valve assembly comprises a valve body 38 within which a spool 40 is shifted by selective energization of the solenoid assemblies to control the directional flow of hydraulic fluid via ports p to which various hydraulic lines (not shown) are connected. The present invention is applicable to various types of directional valves, and hence the hydraulic details, such as the construction of spool 40 and the porting, may be any of a wide variety of specific types. For example, the valve may be a conventional four-way spring-return valve, such as is utilized to control the position of a piston in a hydraulic cylinder. In that type of valve, when one of the two solenoids is energized, hydraulic fluid from a hydraulic pump flows through the valve to one side of the piston while the opposite side of the piston is connected back through the valve to tank. When that solenoid is deenergized and the valve closes, there is no further hydraulic flow to the cylinder. When the other solenoid is energized, the flow of hydraulic fluid reverses.

The present invention pertains to the electrical structure of the valve via which the solenoids receive energizing current. Continuing further with FIG. 1, electrical terminal structure is located at the top of valve body 38 and is enclosed by a removable junction box cover 42. The side wall of cover 42 contains a threaded aperture 44 providing for connection of a mating fitting on a wire-containing conduit assembly (not shown) whereby the electrical wires (not shown) to the valve are protected. The cover is removably secured to the valve body by one or more fastening screws 46 which engage tapped holes (not shown) in the top surface of the valve body.

Associated with each solenoid assembly is corresponding electrical connector structure. For each solenoid a vertical bore 48 and a horizontal bore 50 are provided in the valve body. Each vertical bore 48 extends downwardly for a predetermined distance from the top surface, and is located to one side of a vertical center line through the valve. Each horizontal bore 50 extends inwardly from the end surface which faces the corresponding solenoid assembly to intersect the associated vertical bore 48.

Disposed within each vertical bore 48 is a corresponding terminal block assembly 52 which has been inserted into the open upper end of the bore before the corresponding solenoid has been mounted on the valve body. Each terminal block assembly 52 comprises a terminal block 54 of an electrically non-conductive material, for example a suitable plastic. The block provides electrical installation with respect to the conductive metal constituting the valve body. Two individual electrical conductive paths are provided by each terminal block assembly and in the present embodiment each electrical conductive path for the assembly 52 in FIG. 1 is provided by a terminal 56 formed from a strip of material and an annular threaded terminal element 58 having electrical contact with the top of the corresponding formed strip 56. Each strip 56 and annular element 58 are disposed within a corresponding vertical bore formed in the terminal block. Horizontal bores are also fashioned in the terminal block to intercept the lower ends of the vertical bores within which the elements 56, 58 are disposed. Each horizontal bore is open toward the corresponding solenoid assembly so as to allow the solenoid assembly to make electrical contact with the respective terminal elements 56 in a manner which will be hereinafter explained in greater detail. The wires which are brought into junction box 42 may terminate in eyelet type or fork type terminals, each of which is attached to a corresponding one of the elements 58 by means of a screw 60 which is thraded into the element 58. Energizing current for each solenoid assembly is conducted to the valve via the pair of electrical wires which are connected to the terminal block assembly. The foregoing description of the terminal block assembly is sufficient for purposes of explaining the present invention. Reference may be had to the aforementioned commonly assigned patent application for additional details.

Figure 6:
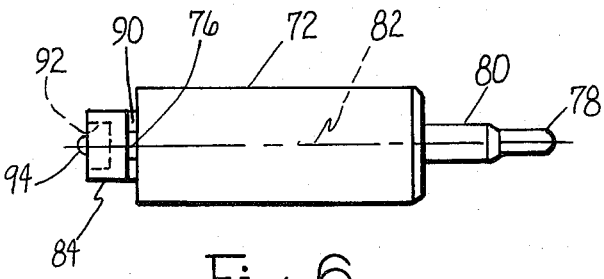
FIG. 6 is a front view of the element of FIG. 5.
Figure 7:
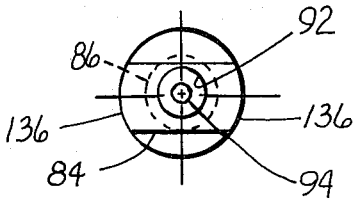
FIG. 7 is a left end view of the element of FIGS. 5 and 6.

A connector element 70 serves to connect each solenoid assembly to the corresponding terminal block assembly 52. Each connector element is separably mounted on its solenoid assembly with FIGS. 1, 2, 3, and 4 illustrating the mounted position. A connector element 70 is shown by itself in FIGS. 5 through 8. Turning to those latter drawing figures one will see that connector element 70 comprises a body 72, formed of an electrically non-conductive material and containing two separate electrically conductive connectors 74 and 76. The connector element is basically of a circular cylindrical shape, and the two connectors 75, 76 extend longitudinally of the connector element. The connector 74 extends the full length of the connector element while the connector 76 extends almost the full length but terminates slightly short of the left-hand end as viewed in FIGS. 5 and 6. The orientation of FIGS. 5 and 6 on the drawing sheet is such that the right-hand end of the connector element is toward the terminal block assembly 52 which is shown in FIG. 1 and the left-hand end is toward the corresponding solenoid assembly 36.

The right-hand end of the connector element has a plug-type structure comprising a pair of plug-in type electrical terminals 78 projecting from the distal ends of small cylindrical protuberances 80 formed on body 72. Each terminal 78 forms the right-hand termination of a corresponding one of the connectors 74, 76. The terminals 78 are of generally cylindrical shape, having rounded noses as shown. Each of the terminals 78 mates with a corresponding one of the terminals 56 in the associated terminal block assembly 52. In this regard the lower portion of each terminal 56 is curled into a tubular shape so that the corresponding terminal 78 can be inserted therein (i.e. plugged in) for good electrical conductive engagement. Once again reference may be made to the above-identified commonly assigned copending patent application if further details are desired. The connection is a wireless type connection and eliminates the problems inherent in wire-type connections such as explained above.

As will be observed in FIG. 1 the body 72 of element 70 is designed for a reasonably close fit within bore 50. Connector element 70, bore 50, and terminal block assembly 52 are so configured that upon assembly of the solenoid assembly to the valve assembly, the body 72 of the connector element engages bore 50 before the rounded noses of terminals 78 engage the terminals 56. In this way there is provided a lead whereby alignment of the terminals 78 with the terminals 56 is facilitated.

The connector element has a central longitudinal axis 82 and the two terminals 78 are symmetrically arranged 180° apart about the axis 82.

A key 84 is formed on the left-hand end of body 72. The key is disposed generally diametrically, and joins to the body by a reduced diameter portion 86. The diametrically opposite ends of the key are radiused on axis 82 at the same radius as that of body 72. Diametrically opposite slots 88 and 90 are also provided by the construction at an axial location spaced from the left-hand end.

A small circular hole 92 is provided in the left-hand end of key 84 concentric with axis 82. The left-hand end of connector 74 exits the body via the center of this circular hole 92 and projects slightly beyond key 84, terminating in a rounded nose 94 forming a terminal. Thus the connector 74 extends the full length of the connector element from the end terminal 78 to the opposite end terminal 94. The intermediate portion of the connector 74 is formed with a bend to accommodate the transition from the eccentrically disposed terminal 78 to the concentrically disposed terminal 94.

The connector 76 does not extend quite the full length of the connector element. It extends axially straight from the corresponding terminal 78 through body 72, across slot 90 and part way into key 84. As will be seen, the portion of connector 76 which is located within slot 90 provides one electrical contact with the solenoid assembly while terminal 94 provides another electrical contact.

Figure 3:
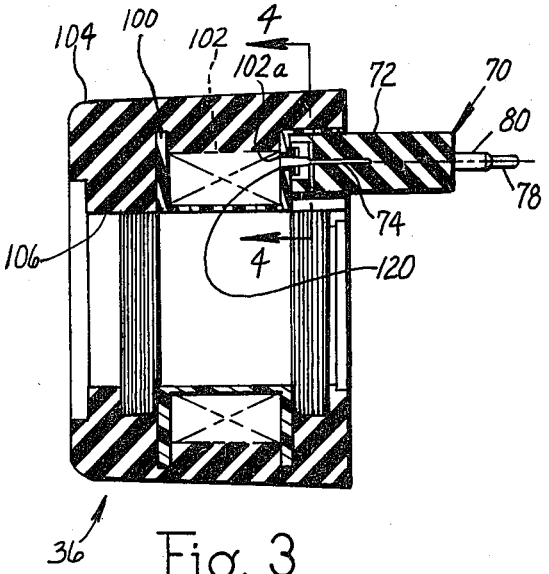
FIG. 3 is a vertical sectional view taken in the direction of arrows 3—3 in FIG. 2.
Figure 9:
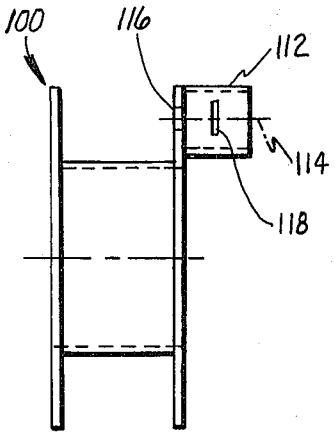
FIG. 9 is a front view of another element shown by itself.
Figure 8:
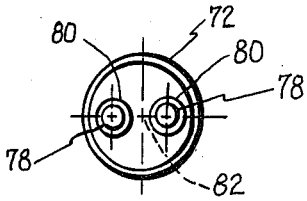
FIG. 8 is a right end view of the element of FIGS. 5 and 6.
Figure 10:
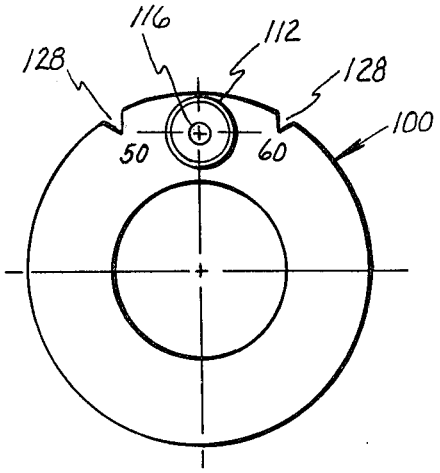
FIG. 10 is a right end view of the element of FIG. 9.

Before the detailed mounting of connector element 70 on solenoid assembly 36 is described, it is appropriate to consider certain details of the construction of the solenoid assembly. Reference is made therefore to FIGS. 3, 9 and 10. The solenoid assembly 36 comprises a bobbin 100 on which a solenoid winding is disposed. The bobbin and winding are encased in a molded dielectric body 104, such as a hard rubber or other similar material. The construction of the solenoid assembly is such that a central bore 106 extends longitudinally concentric with the bore of bobbin 100. The bore 106 is concentric with the central bore of the valve body and the valve spool 40 in the assembled valve. According to conventional practice, stacked laminations are also embedded in the solenoid assembly to provide a magnetic path for conducting the magnetic flux which is generated in winding 102 upon energization thereof to a movable armature or solenoid pin 108 (see FIG. 1) which shifts the valve spool.

Figure 2:
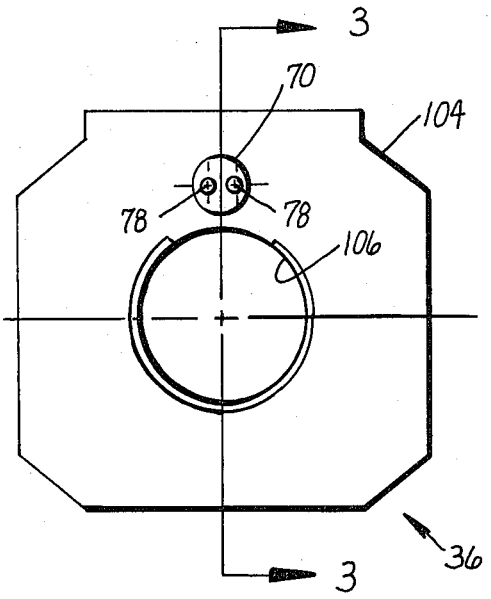
FIG. 2 is a transverse view taken generally in the direction of arrows 2—2 in FIG. 1 and showing a solenoid assembly by itself.

The connector element 70 is assembled to the solenoid assembly 36 (as illustrated in FIGS. 2 and 3) before the solenoid assembly is assembled to valve assembly 32. The valve assembly 32 includes cylindrical end pieces 110 which close the ends of the central bore containing spool 40. These end pieces project axially away from the valve body 38 and contain the armatures, or solenoid pins, which shift the spool. They also have an outside diameter which allows the bores 106 of the solenoid assemblies to fit closely thereon. The assembly procedure involves inserting a solenoid assembly onto an end piece 110 with the connector element 70 concurrently fitting into bore 50 and terminals 78 connecting with terminals 56. The solenoid assembly is secured on the end of the valve assembly by then running a threaded knob 111 onto the threaded end of the end piece 110 to tighten the solenoid assembly against the end of the valve assembly.

Bobbin 100 is shown by itself in FIGS. 9 and 10. The bobbin may be formed according to conventional fabrication techniques as a molded plastic element. In order to embody the invention in its preferred form, the right-hand end wall of the bobbin is provided with a circular cylindrical socket 112 which projects axially away from the bobbin. This socket has an axis 114 which is eccentric with respect to the axis of bore 106. The right-hand end of socket 112 is fully open. The opposite end of the socket is closed by the right end wall of the bobbin except for a small circular through-hole 116 concentric with axis 114. As can also be seen in FIGS. 9 and 10 the sidewall of the socket is provided with a pair of symmetrically disposed slots 118 on diametrically opposite sides. The slots are essentially of uniform width and have the same circumferential extent. Hole 116 and the two slots 118 provide accommodations for the mounting of electrical terminals on the bobbin.

As can be seen in FIG. 3 a small annular electrically conductive terminal 120 is disposed in hole 116 during fabrication of the solenoid assembly. The terminal 120 provides for contact with terminal 94 of the connector element.

Figure 11:
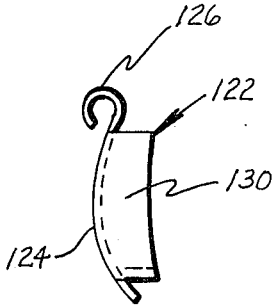
Figure 12:
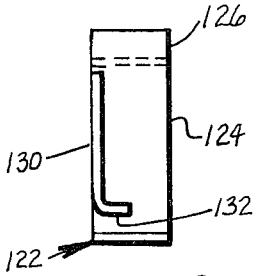
FIGS. 12 and 13 being right and bottom views of FIG. 11.
Figure 13:
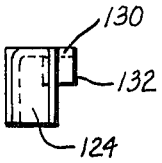

Terminals 122 are mounted on the sidewall of socket 112 at slots 118. A detailed construction for terminal 122 is shown in FIGS. 11, 12 and 13. The terminal comprises an arcuate portion 124 which is disposed in conformance against the sidewall of the socket. One end of this arcuate portion 124 is rolled into a curl 126 which is used to engage a stripped termination of the solenoid winding which is brought out from the central portion of the bobbin through a corresponding one of two notches 128 which are provided in the perimeter of the end wall of the bobbin on either side of the socket. The terminal further includes a radially inwardly directed portion 130 which is joined to the arcuate portion 124 along the forward, or right-hand, edge thereof as viewed in FIG. 9. The radially inwardly directed portion 130 projects through the slot 118 and projects part way into the interior of the socket. A tab 132 is fashioned at the lower end of the inwardly directed portion 130. It will be seen later that this tab defines a circumferential stop for the connector element 70.

Figure 4:
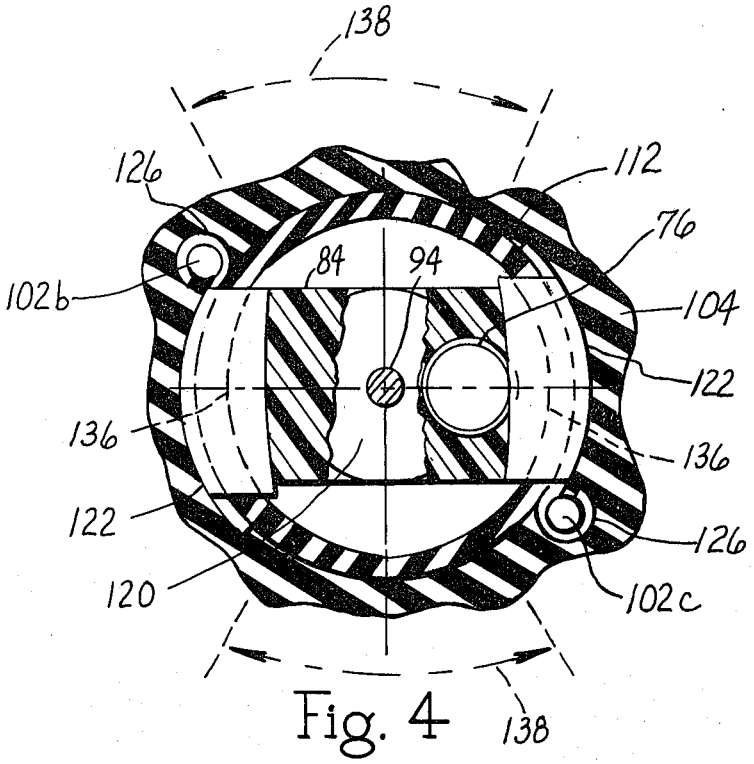
FIG. 4 is a fragmentary cross sectional view taken in the direction of arrows 4—4 in FIG. 3 and enlarged.
Figure 5:
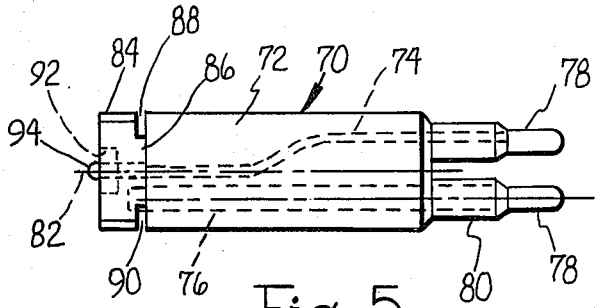
FIG. 5 is a plan view of one element shown by itself.

The terminals 122 are assembled to the socket in the manner shown in FIG. 4. While the socket does not appear to have an accommodation for the tabs 132, its wall is sufficiently thin that each tab 132 will form its own slot in the sidewall when the terminal is forcefully pressed against the sidewall of the socket. The residual plastic material, after having been slit by entrance of the tab 132, will reform so as to approximately close off the opening which was created during penetration. The thickness of the material from which the terminal 122 is constructed is such that it slightly exceeds the width of the slots 118. Hence when terminals 122 are disposed in assembly onto the sidewall of the socket, there are no gross openings in the sidewall which would permit free intrusion of the molding material which is used to form the molded enclosure 104 into the interior of the socket. Should there be any intrusion encountered during fabrication of solenoid assemblies, then the apertures or cracks allowing the intrusion of molding material into the interior of the socket can be closed off by simply putting tape, paper or a filler of some type over the sockets prior to molding. The assembly is encapsulated only after the solenoid winding and terminals have been assembled to the bobbin and connected in the following manner. Solenoid winding 102 is constructed and arranged in such a manner as to provide two winding portions. One winding portion is designed for operation at a particular energizing current frequency while the other winding portion is designed for a different current frequency. In the preferred embodiment these two frequencies are 50 hertz and 60 hertz respectively.

The preferred construction for the solenoid winding 102 comprises attaching one end 102*a* of a conventional solenoid wire to terminal 120 and then winding the wire a predetermined number of turns on bobbin 100 in a conventional manner so as to provide the 60 hertz coil portion. A tap wire 102*b* is then connected to the end of the 60 hertz portion and brought out through the right-hand notch 128 as viewed in FIG. 10 and connected to the curl 126 of the right-hand terminal 122 as viewed in FIG. 4. Additional turns of solenoid wire are further wound on the bobbin in the same sense as the 60 hertz coil portion and the end 102*c* of the wire is brought out through the left-hand notch 128 and connected to the curl 126 of the left-hand terminal 122. The 60 hertz coil portion plus the additional winding turns constitute the second coil portion which is designed for 50 hertz energizing current. It will be perceived that both 50 hertz and 60 hertz portions have a common termination at terminal 120. It will be further observed in FIG. 10 that indicia (i.e. the numbers 50 and 60) are on the end wall of the bobbin at the respective notches 128 as an aid in making the proper connections of the solenoid wire and tap to the respective terminals 122 during fabrication of the solenoid assembly.

With this background description in mind, attention can now be directed to the mounting of connector element 70 on solenoid assembly 36. The connector element is intended to be fully inserted into socket 112 so that the rounded nose terminal 94 makes contact with terminal 120 and so that the portion of the connector 76 which is exposed within slot 90 makes contact with one or the other of the two terminals 122. Thus the axial location of the slots 118 and hence of the inwardly directed portions 130 of terminals 122 are spaced from the wall which contains terminal 120 a distance corresponding to the distance of the slots 88 and 90 from the left-hand end of key 84. The width of the slots 88 and 90 is large enough to accommodate the thickness of portions 130.

Because the inwardly directed portions 130 interfere with the otherwise full circular inside diameter of socket 112, it is necessary to suitably circumferentially index the connector element when it is being inserted into the socket. The indexing must be such that the radiused ends 136 of key 84 are positioned in circumferential registry with the free portions of the socket as approximately indicated by the sectors 138 in FIG. 4. With the connector element so indexed it can be fully inserted into the socket so that terminal 94 electrically contacts terminal 120. At this time slots 88 and 90 are in longitudinal alignment with the inwardly directed portions 130 of terminals 122. If the connector element is now rotated in the counterclockwise sense as viewed in FIG. 4 the portions 130 lodge within the respective slots 88 and 90. The connector element may be rotated until abutment of key 84 with tabs 132 occurs. This condition is shown in FIG. 4 which represents one of two possible fully assembled positions of the connector element on the solenoid assembly. Specifically it is the 60 hertz position.

The radially innermost edge of each radially inwardly directed portions 130 has an arcuate contour disposed so that the terminal makes forceful wiping electrical contact with the portion of connector 76 which is exposed within slot 90, as the connector element is rotated to its assembled position. This can be seen in FIG. 4 where the connection is established with the right-hand terminal 122 as viewed in that drawing figure. In this condition connector 74 is electrically connected with the terminal 120 while the connector 76 is connected with the right-hand terminal 122 in FIG. 4.

In order to convert the solenoid for 50 hertz operation the connector element is removed from the socket, indexed 180°, and then reassembled by the same procedure described above. Now the portion of connector 76 which is exposed within slot 90 engages the opposite terminal 122 (i.e. the left-hand one as viewed in FIG. 4). It will be recalled that this left-hand terminal 122 is the one which provides for 50 hertz operation of the solenoid. Terminal 94 still contacts terminal 120. Hence, in this position the solenoid assembly is set for use with 50 hertz power.

The 180° reversal of the connector element within the socket thereby defines two positions to which the connector element is selectively positionable on the solenoid assembly. Correspondingly, this also creates a reversal of the engagement of the two connector pins 78 with respect to the terminals 56 of the terminal block assembly 52. This however makes no difference insofar as application of electric power supply to the connector element 70 is concerned. The operative effect of the 180° reversal is to select one or the other of the two solenoid winding portions for either 50 hertz operation or 60 hertz operation respectively. Suitable indicia (not shown) may be provided to aid in quickly establishing the appropriate indexing of the connector element for achieving the desired operating frequency.

Accordingly when the valve must be converted for use with a different frequency of power, all that is necessary is to remove the solenoid assembly from assembly relationship with the valve assembly, reposition the connector element 70 on the solenoid assembly according to the procedure explained above, and then reassemble the solenoid assembly to the valve assembly. There is no need to replace the old solenoid by a new solenoid. Furthermore there is no need to rewire lead wires from a solenoid because there are no lead wires emanating from the solenoid embodiment. The invention therefore promotes economy in fabrication as well as convenience in converting the solenoid for use from one frequency to another.

One of the advantages referred to earlier is that the invention can dispense with the need for an adapter element in situations where a given solenoid is suitable with different sized valves. Such differences involve the dimension of the horizontal bore 50 and the relative position of the terminal block assembly 52 in relation to the end face of the valve body against which the corresponding solenoid is disposed. A solenoid can be rendered acceptable for use with these different valve bodies by providing connector elements having different lengths. Whenever a solenoid is to be used with a valve body in which the length of bore 50 is different, the existing connector element 70 is removed and replaced by another connector element having a length which is compatible with the new valve body. This attribute is significant in that it can reduce the complexity of manufacturing and inventory requirements. It is also possible to provide an in-line fuse within the connector element itself so as to provide protection for the solenoid in the event that the wrong voltage is applied to the terminals 78. The in-line fuse can be embedded in the connector element as a part of either one of the connectors 74, 76. When the fuse blows, the connector element is replaced by a new one.

Figure 14:
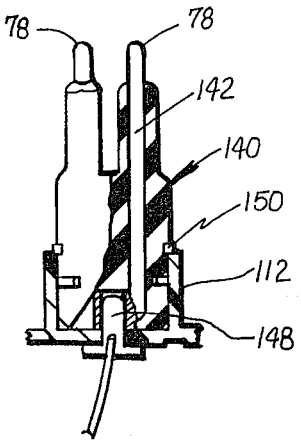
Figure 15:
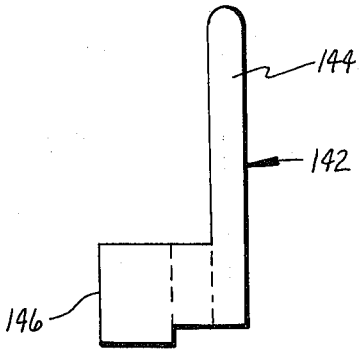
FIGS. 15 and 16 showing one element in detail.
Figure 16:
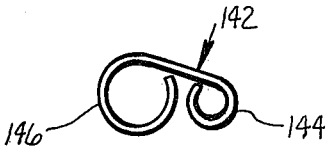

FIG. 14 illustrates a modified form of connector element 140 and its mounting on the bobbin. The connector element 140 differs from connector element 70 in that connector 74 is replaced by a connector 142 which has a slightly different configuration. Connector 142 is shown by itself in FIGS. 15 and 16, and comprises a straight portion 144 of tubular shape. At the end opposite terminal 78, the connector is provided with a terminal 146 formed as a tubular shape coaxial with the axis of connector element 140 and socket 112.

The terminal element 120 of the earlier described embodiment is replaced by a terminal pin 148 at the base of the socket, and the common wire of the windings is connected to it. When the connector element 140 is assembled into socket 112 in the same manner as described above for 70, the protruding terminal pin 148 fits into the tubular terminal portion 146 to establish electrical contact between the two pieces. The two terminals 146 and 148 are dimensioned so that good electrical contact is assured. The remainder of the construction is essentially unchanged except for an O-ring seal 150 disposed in a suitable groove around the outside of the body to seal with the circular edge of the socket in the installed position.

While a presently preferred embodiment of the invention has been disclosed, it will be appreciated that principles of the invention are applicable to other embodiments also.

What is claimed is:

1. In a solenoid operated directional valve comprising a valve assembly and a solenoid assembly assembled together, said solenoid assembly comprising a solenoid winding which is selectively energizable to operate the directional valve, said valve assembly including a valve body and electrical means thereon via which energizing current is conducted to said solenoid winding, said electrical means including a plurality of electrical terminals arranged in a given geometric pattern and constituting a first set of terminals, the improvement which comprises a plurality of electrical terminals constituting a second set of terminals arranged on the solenoid assembly in a given geometric pattern, each terminal of said second set of terminals being connected to a corresponding point of the solenoid winding such that the solenoid winding presents different solenoid characteristics across selected ones of said second set of terminals, and electrical connector structure which is selectively positionable on the solenoid assembly for selectively connecting selected ones of said second set of terminals with said first set of electrical terminals whereby the position of said electrical connector structure on the solenoid assembly establishes the solenoid characteristics which appear at said first set of terminals.

2. The improvement set forth in claim 1 wherein said electrical connector structure and said first set of terminals are arranged and constructed such that the solenoid assembly must be disassembled from its assembled relationship with the valve assembly before the electrical connector structure can be reposition on the solenoid assembly.

3. The improvement set forth in claim 1 wherein said solenoid assembly comprises a cylindrical socket and said connector structure comprises a cylindrical connector element disposed in said cylindrical socket.

4. The improvement set forth in claim 3 wherein said connector element is positionable in a circumferential sense within said socket for selectively connecting selected ones of said second set of terminals with said first set of terminals.

5. The improvement set forth in claim 4 wherein said connector element is positionable to two different positions which are 180° apart in the circumferential sense.

6. The improvement set forth in claim 5 wherein said second set of terminals comprises three electrical terminals and said connector element comprises two electrical connectors, disposed for selective electrical contact with the terminals of said second set of terminals, said two connectors of said connector element comprising one which makes electrical contact with the same one of said three electrical terminals of said second set in both said positions of said connector element, the other connector of said connector element being selectively electrically connectable with the remaining two terminals of said second set in accordance with the position of said connector element with respect to said socket.

7. The improvement set forth in claim 6 wherein said first set of terminals comprises a pair of electrical terminals.

8. The improvement set forth in claim 7 wherein said two connector element connectors are in respective electrical contact with respective ones of said pair of terminals of said first set when the connector element is in one of said positions and with opposite ones of said pair of terminals of said first set when the connector element is in the other of said positions.

9. The improvement set forth in claim 8 wherein the two connectors of said connector element have terminations which interlock with the pair of terminals of said first set in such a manner as to preclude rotation of the connector element when its connectors are connected with the pair of terminals of said first set.

10. The improvement set forth in claim 8 wherein said two connector element connectors at their contacts with said second set of terminals are arranged such that one of said two connector element connectors is concentric with the axis of the connector element about which the connector element is selectively positionable and the other of said two connector element connectors is eccentric with respect to said axis.

11. The improvement set forth in claim 10 wherein two terminals of said second set of terminals are disposed on the sidewall of said socket.

12. The improvement set forth in claim 11 wherein said two terminals on the sidewall of said socket include first portions on the outside of said sidewall and second portions which project inwardly through the sidewall.

13. The improvement set forth in claim 12 wherein the inwardly projecting portions of said two terminals of said second set include circumferential stops disposed to abut and circumferentially locate the connector element in the two 180° apart positions of the connector element within the socket.

14. The improvement set forth in claim 3 wherein said socket is formed as a part of a bobbin on which the solenoid winding is disposed.

15. The improvement set forth in claim 1 wherein said solenoid winding is constructed to provide a portion which is designed for a first frequency of alternating current for energizing the solenoid and another portion which is designed for a second frequency of alternating current to energize the solenoid, said two frequencies being different.

16. The improvement set forth in claim 15 wherein one of said two coil portions is defined by the entirety of said winding and the other portion is defined by a fraction of the entirety of said winding by means of a tap which taps into the entirety of the winding at a point which is a fraction of the total number of winding turns.

17. The improvement set forth in claim 16 in which one end of the winding is common to both winding portions and is electrically connected to one terminal of said second set of terminals, said tap is connected to a second terminal of said second set and the opposite end of the winding is connected to a third terminal of said second set.

18. The improvement set forth in claim 1 in which said first set of terminals comprises two terminals said second set of terminals comprises three terminals, and said connecting structure comprises a connector element having two connectors, said connector element being selectively positionable to two positions, one position comprising one of said two terminals of said first set being electrically connected via one connector of said connector element to one of said three terminals of said second set and the other of said two terminals of said first being electrically connected via the other connector of said connector element to a second of said three terminals of said second set, the other position comprising said one of said two terminals of said first set being electrically connected via said one connector of said connector element to said one of said three terminals of said second set and the other of said two terminals of said first set being electrically connected via said other connector of said connector element to the third of said three terminals of said second set.

19. An improved plug-in type solenoid assembly which can be readily converted for use at a new frequency of energizing current different from a previous frequency, said solenoid assembly comprising a body, a plurality of electrical terminals arranged in a given geometric pattern on said body, a solenoid winding disposed on said body, each terminal being connected to a corresponding point of the solenoid winding such that the solenoid winding presents different solenoid characteristics across selected ones of said plurality of terminals, and electrical connector structure comprising plug-in type terminals which is selectively positionable on the solenoid body for selectively connecting selected ones of said plurality of terminals with said plug-in terminals whereby the position of said electrical connector structure on the solenoid body establishes the solenoid characteristics which appear across said plug-in terminals of said connector structure.

20. A solenoid assembly as set forth in claim 19 in which the solenoid body comprises a socket with which said plurality of terminals are associated, said electrical connector structure comprising a connector element which is selectively positionable within said socket to selectively connect selected ones of said plurality of terminals with said plug-in terminals.

* * * * *